United States Patent [19]

Brown et al.

[11] Patent Number: 4,522,386

[45] Date of Patent: Jun. 11, 1985

[54] PAPER FEEDING MECHANISM

[76] Inventors: Bruce Brown; William C. Brown, both of 926-C N. Maclay Ave., San Fernando, Calif. 91340

[21] Appl. No.: 503,494

[22] Filed: Jun. 10, 1983

[51] Int. Cl.[3] ..... B65H 1/08

[52] U.S. Cl. ..... 271/147; 271/171; 271/223

[58] Field of Search ..... 271/147, 171, 152, 160, 271/217, 223, 224; 414/118, 211

[56] References Cited

U.S. PATENT DOCUMENTS

| | | | |
|---|---|---|---|
| 2,444,580 | 7/1948 | Pratt et al. | 271/171 |
| 4,097,042 | 6/1978 | Rozga | 271/171 |
| 4,245,834 | 1/1981 | Songer et al. | 271/223 |

*Primary Examiner*—Bruce H. Stoner, Jr.

*Assistant Examiner*—John A. Carroll

*Attorney, Agent, or Firm*—Sanford Astor

[57] ABSTRACT

The present invention relates to a paper feeding mechanism primarily for printing presses, or the like machines, comprising a left and right interlocking grill, which supports the stack of paper which is fed to the press. The adjustable grill rests on a center base support and the press side support pieces. The grill is adjustable in a horizontal direction depending on the width of the paper, in conjunction with the left and right hand paper pile support guides. The paper feeding mechanism also comprises an adjusting rear paper pile feeding guide adapted to press against the rear of the paper pile, holding it against the front feeder plate of the press. As the paper pile rises an inverted V-shaped feed guide gradually opens allowing the paper to keep rising until all sheets are fed into the press.

5 Claims, 4 Drawing Figures

PAPER FEEDING MECHANISM

BACKGROUND OF THE INVENTION

This invention relates to an adjustable paper pile support which is adapted to rest on top of the paper pile raising platform of various offset duplicator printing presses, such as the AB Dick No. 350 and No. 360, or any other printing presses of similar design. The presses mentioned have their own adjustable paper pile feeding side guides. Side support pieces to these guides are approximately 12 inches long, ¾ inch wide, and 2 inches high.

The problem in feeding paper of various lengths and widths with the paper feeding mechanism that exists on the printing presses mentioned is that the press pile support pieces furnish only ¾ inch of support at the left and right hand side of the paper. This means that some form of support must be supplied for the paper between these pile support pieces for its width and length. The commonly used method of supplying such support is to cut boards of various materials, such as wood, to widths and lengths approximately the size of the paper sheets to be printed. These are then placed so that their left and right hand edges rest upon the pile support pieces. These boards are then usually taped to the pile support pieces to keep them from slipping backwards during the feeding of the paper. This method is extremely inconvenient in that different boards must be put on to the machine each time a different size paper is used, and taped to the machine.

Since the paper pile support mechanism of this invention is adjustable to any size of paper being fed into the press, it completely eliminates the need for these boards.

BRIEF DESCRIPTION OF THE INVENTION

An example of the invention will now be described, with reference to the accompanying drawings in which FIG. 1 is a perspective view of the adjustable paper pile support system of the present invention;

DETAILED DESCRIPTION OF THE INVENTION

Figure 1:
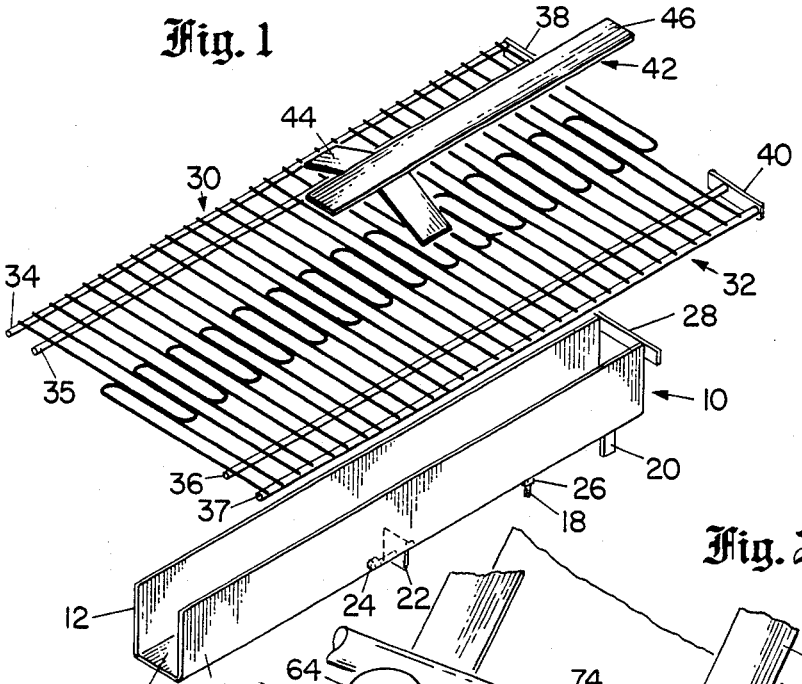

The adjustable paper pile support system of the present invention comprises a concave center pile support piece 10 comprising vertical sides 12 and 14, and a base plate 16. The center pile support piece 10 is fastened to the center of the paper pile raising platform on the existing press, FIG. 2, parallel to the length of the paper pile by means of a bolt 18, which projects through a hole in the base plate 16, which coincides with the location of a right angle slot in the top of the paper pile raising platform on an existing press.

Attached to the underside of the base plate 16 is a front overhang 20 and a rear overhang 22, the front overhang 20 is positioned to overhang the front of a paper pile raising platform on an existing press, and the rear overhang 22 has a threaded hole to receive a thumb screw 24. The thumb screw when tightened against the rear frame of the paper pile feeding platform of the press, pulls the front overhang piece 20 firmly against the front frame of the platform of the press, thus securing the center pile support piece 10 against any forward or backward movement while the rising paper is fed into the press.

A wing nut 26 is then attached to the end of the bolt 18 which projects through the bottom of the base plate 16 into the slot in the top of the pile feeding platform of the press, and, when a wing nut 26 is tightened, pulls the head of the bolt 18 tightly against the bottom of the base plate 16 preventing any side movement.

There is a stop bar 28 attached to the front of the center support piece across the two vertical sides 12 and 14, which serves as a pile raising stop when feeding narrow paper sheets without the adjustable paper pile support grill as will be later described.

The adjustable paper pile support grill consists of a left hand 30 and a right hand 32 interlocking grill fingers which may be pushed in or out to accomodate various widths of paper. The inner ends of the grill fingers rest on top of the center piece 10. The outside ends of the grill fingers are tied together by two metal parallel bars at each end 34, 35, 36 and 37, welded to the bottoms of the grill fingers at right angles to the fingers. These metal bars 34, 35, 36 and 37 are adapted to fit snugly over the length of the side support pieces of the press itself (FIG. 2) thus holding the grill support in place as it is moved in and out. At the front end of each grill are overhang pieces 38 and 40 which are adapted to fit over the end of the side support pieces of the press and keep the grill from slipping back during the feeding of the paper.

It is necessary to keep the front edge of the paper pile pressed against the feed plate as it rises and sheets feed into the press. This is done by the use of a rear paper pile guide 42. The rear paper pile guide 42 consists of an inverted V-shaped attachment piece 44 connected to the longitudinal back guide retainer plate 46 of the press. The rear V-shaped attachment 44 must hang down behind the paper pile to a depth of approximately 2 inches. As the pile raises it reaches a diminishing height of approximately ½ inch. Since the pile support grill 30, 32 presents an almost solid surface as it rises to a point of contact with the V-shaped attachment 44, the V-shaped attachment 44 must adjust so that the paper pile can keep moving up until the last sheets have been taken from it. As the surface of the rising paper support grill 30, 32 contacts the inverted V-shaped attachment piece 44, this attachment 44 adjusts by spreading apart which is accomplished by having it manufactured from a metallic or other substance which has the capability of bending as pressure is placed upon it, such as spring steel.

Figure 2:
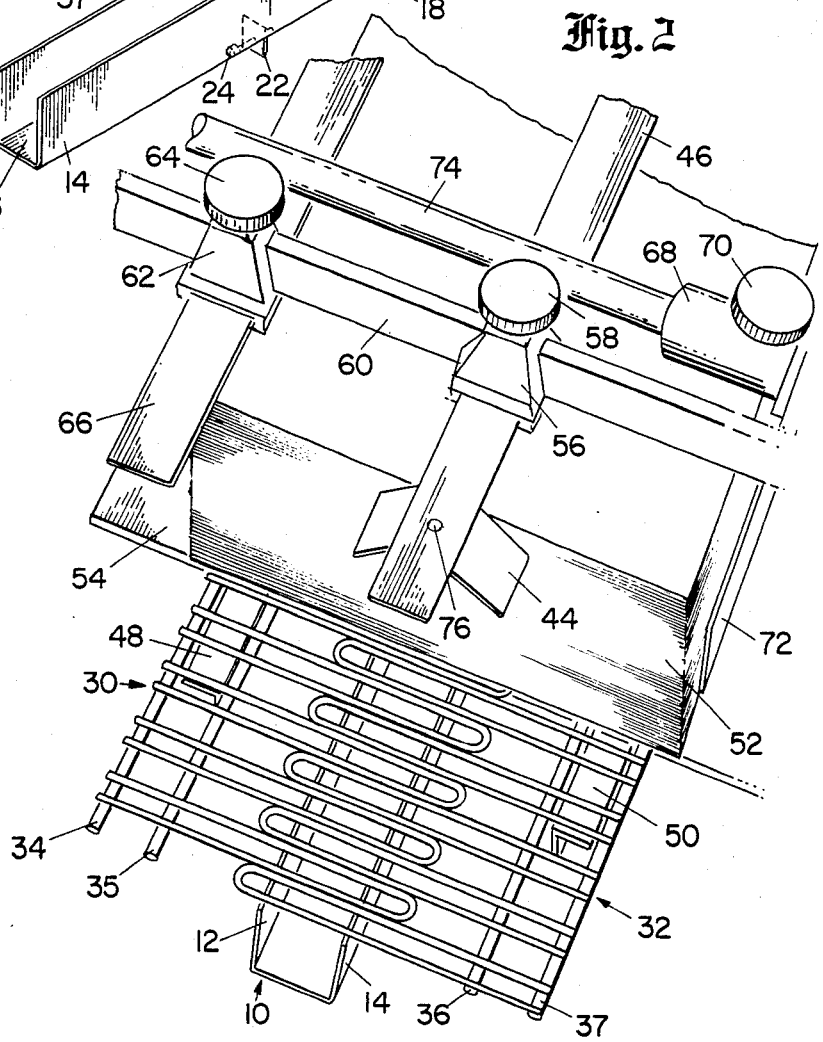
FIG. 2 is a perspective view of the device on the press.

Referring now to FIG. 2, there is shown the device of the present invention attached to a press. Shown are the grill interlocking fingers 30, 32 with the parallel bars 34, 35, 36 and 37.

The grill fingers rest on the vertical sides 12 and 14 of the center pile support piece 10.

The outer ends of the grill fingers 30, 32 rest on the side support pieces 48, 50, a part of the press itself. The parallel bars 34, 35, 36 and 37 are adapted to frictionally fit and be held over the side support pieces 48, 50.

A stack of paper 52 is shown resting on the grill fingers 30, 32. The center pile support piece 10 is attached by the bolts 18 and rear overhang 22 to the paper pile raising platform 54 of the press.

The back guide retainer plate 46 is held by a clamp 56 and thumbscrew 58 to loosen and tighten the clamp 56, the clamp being slidably mounted on a transverse support rod 60. Another clamp 62 with a thumbscrew 64 are slidably mounted on the rod 60 to hold a spring activated side guide 66. Another clamp 68 with a thumbscrew 70 holds an abutment side guide 72. The clamp 68 is mounted on another support rod 74. These clamps and rods are all part of the existing press.

The inverted V-shaped attachment 44 which is part of the device of the present invention, is removably attached to the back guide retainer plate 46 by any convenient method, such as a bolt or screw 76. This V-shaped attachment or adjusting back guide 44 is a separate part which may be removed from the back guide retainer plate 46 when very narrow paper is being fed into the press and the V-shaped attachment is then replaced by a straight vertical piece 78, shown in FIG. 3 and FIG. 4, furnished with the press.

Figure 3:
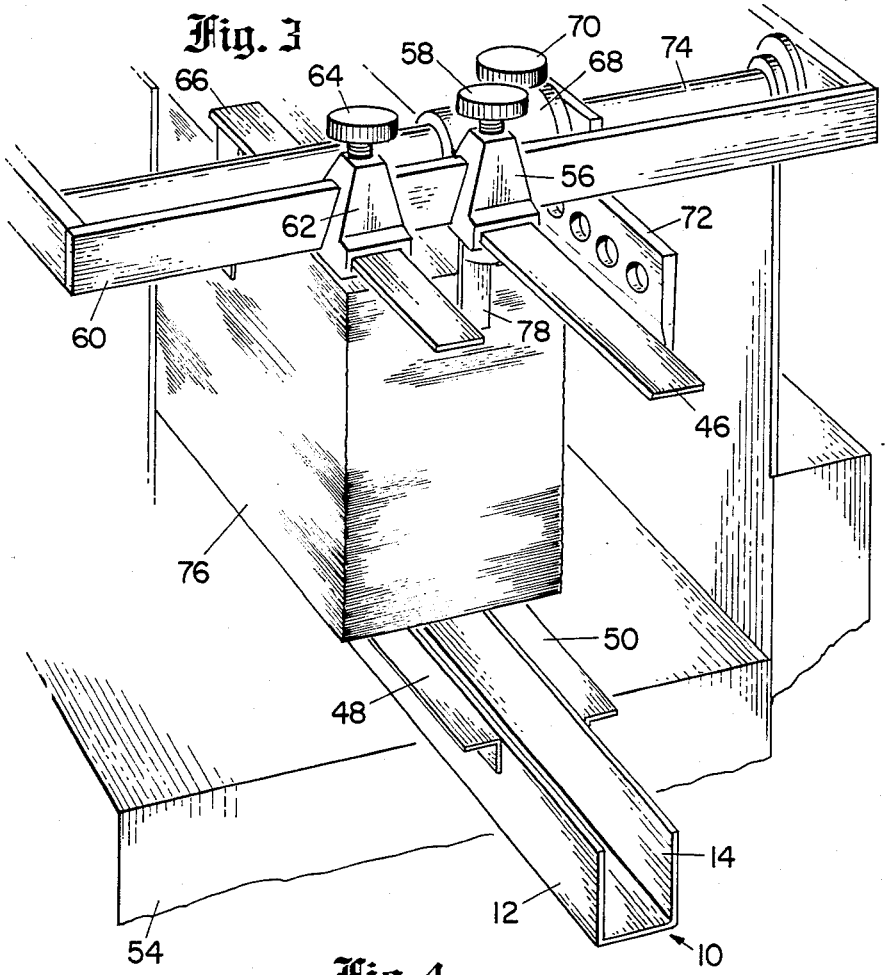
FIG. 3 is a perspective view when small paper is used.
Figure 4:
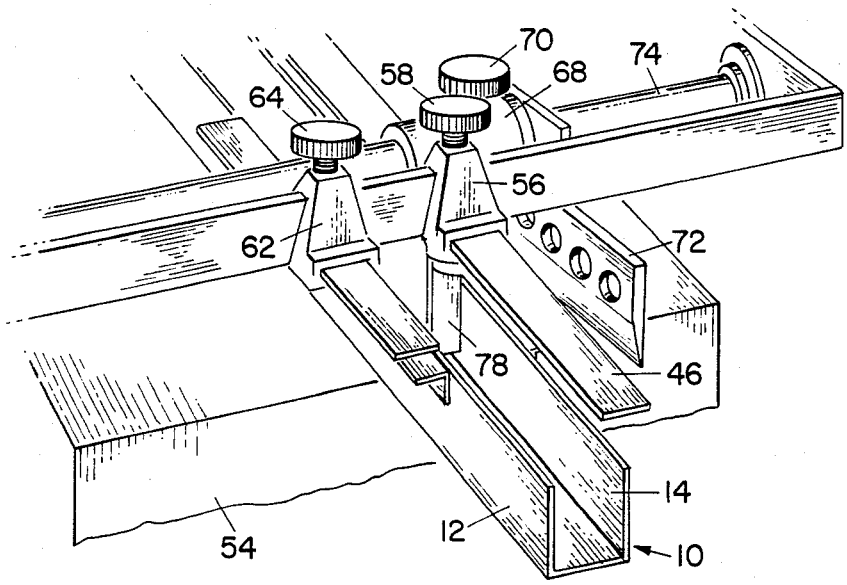
FIG. 4 is a perspective view without the paper present.

Referring now to FIG. 3 and FIG. 4, there is shown the use of the invention for very narrow paper less than 5½ inches wide. The grills 30, 32 have been removed and the paper pile 76 rests directly on the center pile support piece 10 on the top of vertical sides 12, 14. The existing press side support pieces 48 and 50 are moved up against center piece 10. The paper pile platform 54 of the press is under the center piece 10 and when platform 54 rises it pushes up the center piece 10 and thus the paper pile 76. The paper is fed to the press one sheet at a time from the top end of the pile 76.

The transverse support bar 60 is shown with clamps 56 and 62, and thumbscrews 58 and 62. Clamp 62 holds spring activated side guide 66 and clamp 56 holds the back guide retainer plate 46. The V-shaped attachment has now been removed and a vertical bar 78 replaces it so that as the paper pile rises the vertical bar 78 can move down into the cavity between the vertical sides 12 and 14 of the center piece 10 allowing the last sheet of paper to rise and be fed into the press.

Clamp 68 with thumbscrew 70 holds abutment side guide 72. Clamp 68 is slidably held on rod 74.

Thus the device of the present invention is capable of handling very small paper, less than 5½ inches width, by removing the grill supports 30, 32 themselves, and leaving the two side support pieces from the press and the center support piece 10 as the paper support. Thus the side support pieces and the center support piece 10 form a support for very small paper. The rigid rear paper pile guide 78 hangs down behind the paper pile approximately 2 inches. Since it is rigid, it presents the problem of contact with any solid surface rising higher than its 2 inch depth. Because the center guide 10 is of concave design with opening between the two vertical pieces 12 and 14, this allows the rigid rear paper guide 78 to enter it to the depth which prevents any contact with the solid surface, thus allowing the paper pile to continue rising until all sheets are fed into the press.

The device of the present invention is thus capable of providing an adjustable paper pile support for standard printing presses which are used today which themselves do not contain an adjustable paper pile support system.

The device of the present invention is adapted to be attached to these existing presses as they are presently made so that no modifications of the existing presses are necessary.

Having thus described the invention, it is required that the scope of the invention be defined by the following claims.

We claim:

1. An adjustable paper feeding device for a printing press having a paper pile platform which rises to feed paper to the press and paper pile side supports, said adjustable paper feeding device comprising a concave base center support piece fixedly attached to the paper pile platform, removable and adjustable left and right interlocking grills resting on the concave base center support and frictionally attached by means integral with the grills to the paper pile side supports, a flexible rear paper pile feeding guide mounted above the paper pile platform to flex in a vertical direction as the interlocking grills rise to contact the rear paper pile feeding guide.

2. The device of claim 1 in which the adjusting rear paper pile feeding guide comprises an inverted V-shaped part.

3. The device of claim 1 in which the grill fingers frictionally attach by means of two sets of parallel cross bars.

4. The device of claim 1 in which the grill fingers and adjusting rear paper pile feeding guide are removable to feed narrow paper.

5. The device of claim 2 in which the inverted V-shaped part is spring steel.

* * * * *